US005962976A

United States Patent [19]

Irisawa et al.

[11] Patent Number: 5,962,976

[45] Date of Patent: Oct. 5, 1999

[54] MOLYBDENUM FOILS WITH YTTRIUM OXIDE AND RECRYSTALLIZATION GRAINS NO MORE THAN 50 MICRONS WITHIN THE PINCH SEALS OF A METALLIC HALIDE LAMP

[75] Inventors: Shinichi Irisawa; Takeshi Fukuyo; Nobuo Ohkawai; Yoshitaka Ohshima, all of Shimizu, Japan

[73] Assignee: Koito Manufacturing Co., Ltd., Tokyo, Japan

[21] Appl. No.: 09/136,688

[22] Filed: Aug. 19, 1998

[30] Foreign Application Priority Data

Aug. 21, 1997 [JP] Japan ..... 9-224674

[51] Int. Cl.[6] ..... H01J 17/18

[52] U.S. Cl. ..... 313/623; 313/318.07; 445/2.7

[58] Field of Search ..... 313/623, 318.07

[56] References Cited

U.S. PATENT DOCUMENTS

| | | | |
|---|---|---|---|
| 4,254,300 | 3/1981 | Thompson-Russell | 313/331 |
| 4,419,602 | 12/1983 | Mitamura et al. | 313/332 |
| 5,277,639 | 1/1994 | Nagata et al. | 445/26 |
| 5,286,227 | 2/1994 | Numajiri et al. | 445/26 |
| 5,426,343 | 6/1995 | Rhodes et al. | 313/623 |
| 5,542,867 | 8/1996 | Hishinuma et al. | 313/332 |
| 5,606,141 | 2/1997 | Leichtfried | 75/235 |

FOREIGN PATENT DOCUMENTS

| | | |
|---|---|---|
| 0 275 580 A1 | 7/1988 | European Pat. Off. . |
| 0 512 632 A1 | 11/1992 | European Pat. Off. . |
| 06 91 673 A2 | 1/1996 | European Pat. Off. . |
| 29 47 230 A1 | 6/1980 | Germany . |
| 196 03 301 A1 | 7/1997 | Germany . |
| 1005495 | 12/1997 | Netherlands . |

*Primary Examiner*—Nimeshkumar D. Patel
*Assistant Examiner*—Ronald E. DelGizzi
*Attorney, Agent, or Firm*—Sughrue, Mion, Zinn, Macpeak & Seas, PLLC

[57] ABSTRACT

A metallic halide lamp has an envelope of silica glass defining a discharge chamber with a pair of pinch seals extending in opposite directions therefrom. A pair of tungsten electrode stems are partly buried in the respective seals and electrically connected to a pair of molybdenum lead wires via a pair of molybdenum foils which are wholly embedded in the pinch seals. The molybdenum foils have a recrystallization grain size of not more than about 50 $\mu$m.

3 Claims, 5 Drawing Sheets

MOLYBDENUM FOILS WITH YTTRIUM OXIDE AND RECRYSTALLIZATION GRAINS NO MORE THAN 50 MICRONS WITHIN THE PINCH SEALS OF A METALLIC HALIDE LAMP

BACKGROUND OF THE INVENTION

This invention relates generally to electric lamps and particularly to metallic halide lamps for use, for example, on motor vehicles or the like. More particularly, the invention deals with improvements concerning the molybdenum foils that are embedded in the pinch seals of a metallic halide lamp for electrically connecting the pair of discharge electrodes to leads.

Generally, a metallic halide lamp has its envelope composed of a length of glass tube, with its opposite ends pinch sealed to provide a hermetically closed discharge chamber therebetween in which there are contained substances such as a metallic halide, xenon, and mercury. A pair of electrodes are partly disposed in the discharge chamber and partly embedded in the pinch seals. Also partly embedded in the pinch seals, a pair of leads are connected to the electrodes via molybdenum foils to which the instant invention pertains.

There might be contemplated the use of either hard glass or silica glass for the lamp envelope. For its higher coefficient of linear expansion, $50\times10^{-7}$ (1/° C.), hard glass is undesirable because the envelope of a metallic halide lamp is heated to a temperature of as high as 900° C. in use, at which hard glass would be deformed or lose transparency. As an additional disadvantage, hard glass contains substances in addition to silica. These additives would luminesce on arc discharge, imparting an undesired hue to the color in which the lamp is intended to give off light.

Silica glass is therefore a currently preferred material for the envelope of a metallic halide lamp. However, silica glass demands some special considerations in its use for high temperature applications, as in this one, by reason of its low coefficient of linear expansion, $5.5\times10^{-7}$ (1/° C.). Usually, the lead wires of a metallic halide lamp are made from molybdenum, and the electrodes from tungsten. Molybdenum lead wires are $60\times10^{-7}$ (1/° C.), and tungsten electrodes $40\times10^{-7}$ (1/° C.) , in coefficient of linear expansion. It is therefore undesirable to bury any extended lengths of the molybdenum lead wires and the tungsten electrodes in the pinch seals by directly interconnecting them.

This difficulty has been overcome, though conventionally to a limited extent, by interposing foils of molybdenum between electrodes and leads and burying the molybdenum foils in the pinch seals. The molybdenum foils are less affected by the difference in coefficient of linear expansion despite the expansion and contraction of the glass envelope which are repeated numerous times in use of the lamp. Less relative displacement and less gap creation are known to occur between molybdenum foils and pinch seals than between molybdenum wires and pinch seals, and so are less cracks and consequent leakage of the gasses from the discharge chamber.

The foregoing evaluation of the conventional molybdenum foils does not imply that they are per se satisfactory; only, they provide better results than if the tungsten electrodes were directly connected to the molybdenum lead wires within the pinch seals. A difference in coefficient of thermal expansion does exist between molybdenum foils of conventional make and silica glass pinch seals. Relative displacement and gap creation do occur between them, and so do cracks and gas leakage. These shortcomings have made the useful life of prior art metal halide lamps less than a half of their expected lifetime.

So the present applicant has conducted extensive microscopic studies of the prior art molybdenum foils within the pinch seals of metallic halide lamps in order to pinpoint the reasons for the insufficient service life of conventional metal halide lamps. The studies have revealed the following findings:

1. The recrystallization grain size of the prior art molybdenum foils is generally over 50 microns; more particularly, from 50 to 100 microns in the case of 99.95% pure molybdenum, and 100 microns or more in the case of 99.90% pure molybdenum.
2. The prior art molybdenum foils provide a smooth interface with the silica glass pinch seals as viewed on the level of recrystallization grains.

The term "recrystallization grains" is used in the foregoing findings because the crystal grains of the prior art molybdenum foils within the pinch seals of metallic halide lamps are obviously unlike those before the foils are embedded in the pinch seals. Manufactured by rolling, as is usually the case, molybdenum foils have their crystal grains rendered as fine as from five to thirty microns. The foils undergo recrystallization, however, into larger crystal grains on being heated and compressed via the heated glass when the glass envelop is pinch sealed at temperatures of 1600–2000° C., which are far above the softening point of silica glass. Molybdenum recrystallization is known to start at about 1300° C. Subjected to the much higher temperatures of 1600–2000° C. and pressurized at the same time, the prior art molybdenum foils within the pinch seals have readily recrystallized into much coarser grains of over fifty microns.

Having been embedded as above in the pinch seals with their crystal grains made inconveniently larger in size, the prior art molybdenum foils have been easy to expand on being heated each time the lamp glows. The molybdenum foils on thermal expansion have exerted correspondingly great stresses on the pinch seals until slips occur at the interface between molybdenum and glass. Such slips and resulting gaps have grown greater as the lamp is repeatedly switched on and off in use, with the accompanying expansion and contraction of the molybdenum foils and the glass pinch seals at different rates. Furthermore, when the lamp is glowing, the gas pressure in the discharge chamber rises, conventionally finding its way into the gaps between glass and molybdenum of the pinch seals via gaps that are produced around the electrodes in a like manner. Accelerated by these migrant gas pressures, the gaps have eventually grown into cracks permitting gas leakage from the discharge chamber into the atmosphere. Hence the unwarrantably short service life of metallic halide lamps with the conventional molybdenum foils of large recrystallization grains.

SUMMARY OF THE INVENTION

The present invention aims at the provision of a metallic halide lamp of much longer useful life than heretofore through improvement of the molybdenum foils buried in the pinch seals of the lamp.

For the attainment of the foregoing object the invention proposes to hold the crystal grains of the molybdenum foils not more than fifty microns after pinch sealing.

Typically, the molybdenum foils of such fine crystal grains, or recrystallization grains, are obtainable by use of foils of molybdenum doped with a minor proportion of yttrium oxide (yttria), $Y_2O_3$. The same objective may be attained, however, as by pinch sealing the glass envelope at lower temperatures, or in shorter lengths of time, than heretofore.

The finer crystal grains of the molybdenum foils according to the present invention will expand and contract in various directions to various degrees with the switching of the lamp on and off in use. The result is the scattering of the stresses that are consequently applied to the pinch seals. The stresses are believed to become even less by the easier relative sliding of the grains and the greater pliancy resulting from the interfaces among the grains.

The finer crystal grains also results in the creation of fine irregularities at the interface between the foils and the pinch seals, in an increase in the total areas of contact therebetween, and therefore in an increase in the strength with which they are bonded together. This obviously serves to reduce the creation of gaps therebetween which might develop into cracks.

The above and other objects, features and advantages of this invention will become more apparent, and the invention itself will best be understood, from a study of the following description and appended claims, with reference had to the attached drawings.

DESCRIPTION OF THE PREFERRED EMBODIMENT

Figure 1:
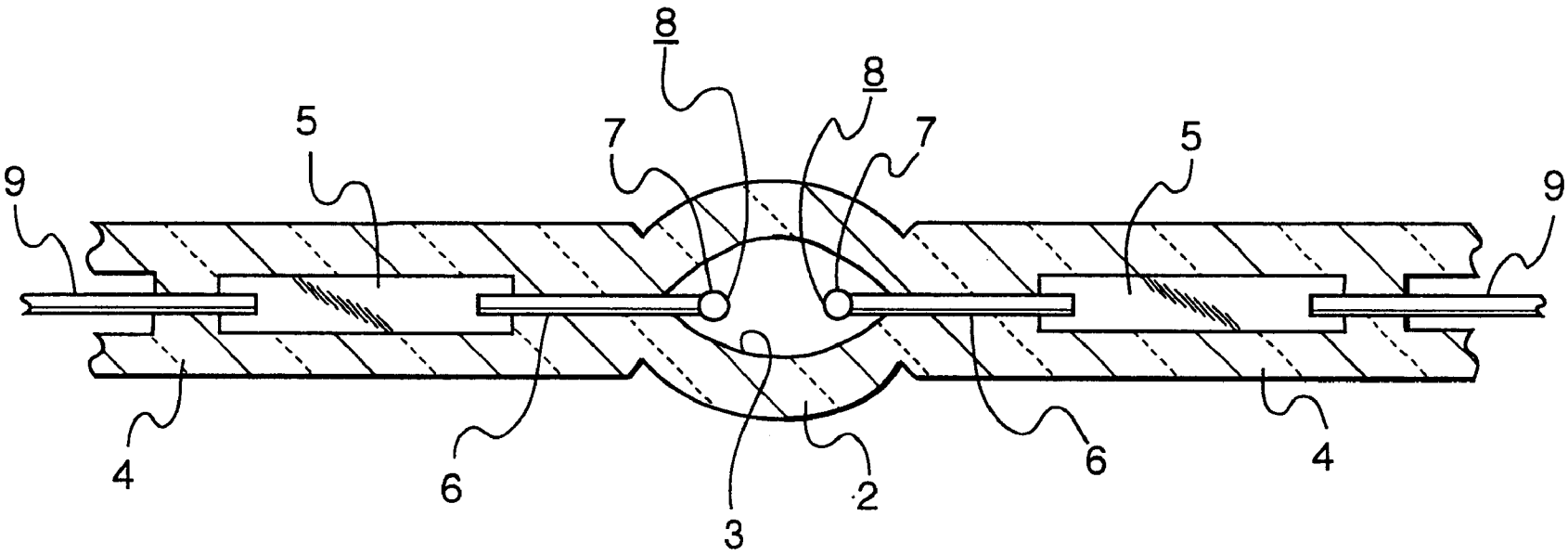
FIG. 1 is a longitudinal section through the metallic halide lamp embodying the principles of the present invention.

The invention will now be described more specifically as embodied in a metallic halide lamp for use as a vehicular headlamp. With reference to FIG. 1 the exemplified lamp has a silica glass bulb or envelope 2 defining a discharge chamber 3 of generally globular shape. The discharge chamber 3 conventionally contains mercury and one or more metallic iodides together with one or more of such inert gases as argon, xenon, and krypton under pressure. The bulb 2 is formed in one piece with a pair of pinch seals 4 extending in opposite directions therefrom in alignment with each other.

At 8 are seen a pair of discharge electrodes of tungsten each including a stem 6 and a ball 7. Partly buried one in each pinch seal 4, the electrode stems 6 extend into the discharge chamber 3 to terminate in the balls 7.

Within the pinch seals 4 the electrode stems 6 are joined respectively to a pair of rectangular shaped foils 5 of molybdenum and thence to a pair of lead wires 9 which also are of molybdenum. The molybdenum foils 5 are wholly embedded in the pinch seals 4 whereas the molybdenum lead wires 9 have only their minimal lengths buried in the pinch seals and other parts projecting therefrom.

In this particular embodiment of the invention the molybdenum foils 4 are doped with 0.5% yttria in order to make the recrystallization grains of the resulting foils not more than 50 microns in size. Speaking more broadly, however, from about 0.1% to about 2.0% yttria can be added since, even in these cases, the recrystallization grains of the resulting foils are mostly not more than 50 microns, as has been ascertained by experiment. Approximately 0.5% is nevertheless most desirable for providing metallic halide lamps that will infallibly operate satisfactorily throughout their expected lifetime.

The metallic halide lamp of the foregoing construction permits manufacture by the same method as heretofore. Particularly, doped with 0.5% yttria according to this invention, the molybdenum foils 5 have proved to resist recrystallization when exposed to the temperatures of 1600–2000° C. during pinch sealing. Although some recrystallization of the preformed fine crystal may be unavoidable, particularly at high pinch sealing temperatures, it is nevertheless clear that they do not grow so large as in the known case where yttria is not introduced. Thus the crystal grains of the yttria-doped molybdenum foils 5 after pinch sealing can be held less than 50 microns.

Accelerated lifetime tests were conducted in order to compare the lifetime of the metallic halide lamp of the above improved construction according to the present invention with the lifetimes of the prior art lamps of the same construction and the same method of manufacture except for the composition of the molybdenum foils. The results were as tabulated below:

| Lamp | Grain Size (x) (micron) | Samples | Average Lifetime (hours) |
|---|---|---|---|
| A | $x \geqq 100$ | 4 | 113 |
| B | $50 < x < 100$ | 5 | 341 |
| C | $x \leqq 50$ | 10 | 1,084 |

Three kinds of lamps, Lamp A, Lamp B, and Lamp C, were used in the tests. Lamp A represent a prior art metallic halide lamp with molybdenum foils containing some impurities. Lamp B represent another prior art metallic halide lamp with 99.95% pure molybdenum foils. Lamp C represents a metallic halide lamp with the yttria-doped molybdenum foils according to the present invention.

Figure 2:
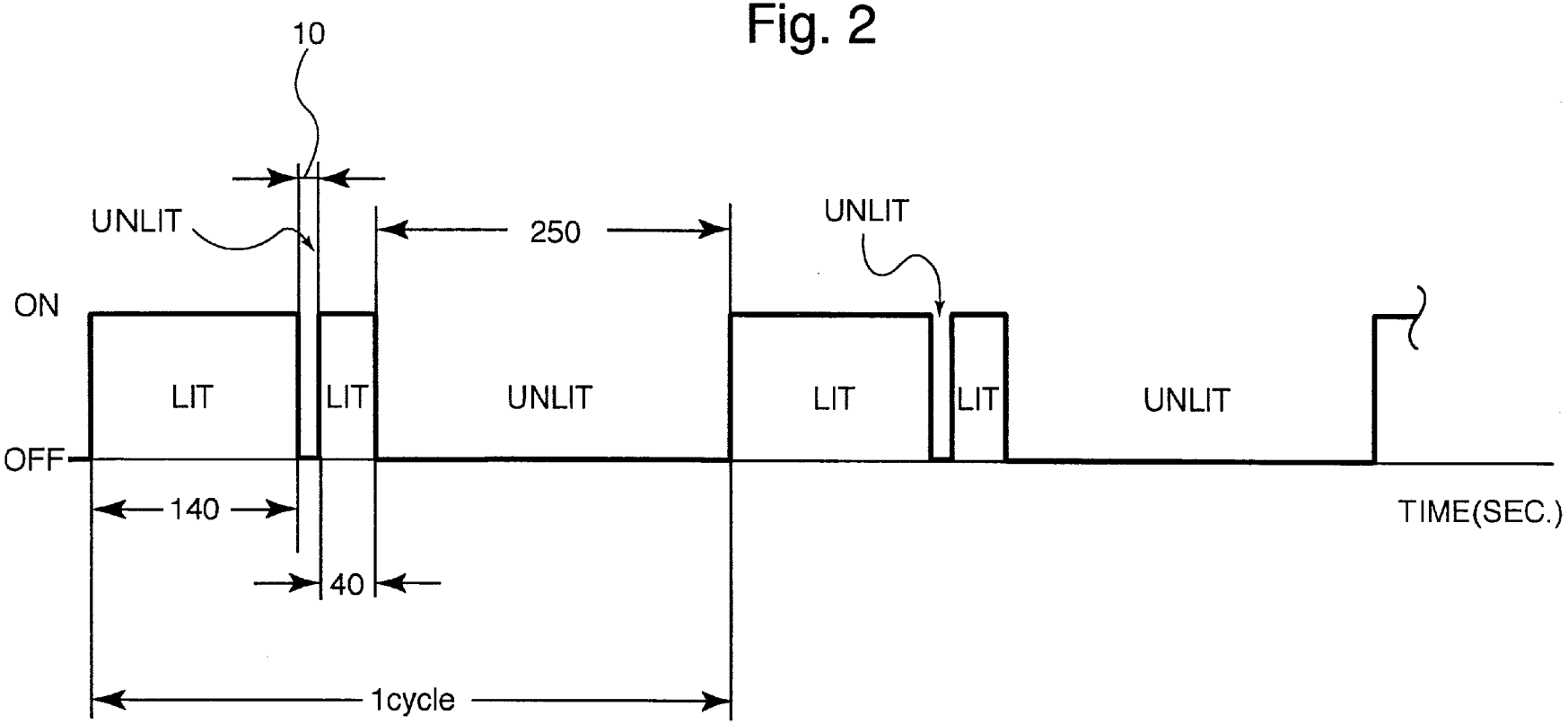
FIG. 2 is explanatory of accelerated lifetime tests that were conducted to determine the useful life of the improved lamp according to the invention in comparison with that of some prior art lamps.

As diagramed in FIG. 2, the accelerated lifetime tests were such that each lamp was put to a series of operating cycles in each of which the lamp was lit 140 seconds, unlit 10 seconds, lit 40 seconds, and unlit 250 seconds. This operating cycle was repeated until the enclosed substances started leaking.

The Table above indicates that the four samples of prior art Lamp A, having the impure molybdenum foils with a recrystallization grain size of not less than 100 microns, was 113 hours in average lifetime.

The five samples of prior art Lamp B, having the pure molybdenum foils with a recrystallization grain size of from 50 to 100 microns, averaged 342 hours in lifetime. The average lifetime of ten samples of inventive Lamp C, having the yttria-doped molybdenum foils with a recrystallization grain size of not more than 50 microns, was 1084, approximately ten times as long as that of prior art Lamp A and three times as long as that of prior art Lamp B.

The remarkably longer life of the lamp according to this invention may be explained as follows: The yttria-doped molybdenum foils 5 with the smaller recrystallization grains provide very irregular interfaces with the silica glass pinch seals 4, as depicted on a greatly enlarged scale in FIG. 4. On being heated in use of the lamp, the fine grains of the yttria-doped molybdenum foils 5 will expand in various directions to various degrees, with the consequent scattering of stresses applied to the pinch seals 4, as in FIG. 3. The stresses exerted on the pinch seals will become even less by reasons of the relative sliding of the crystal grains and the pliancy of their own interfaces.

It is also noteworthy that the fine irregularities of the recrystallization grains serve to increase the total area of contact between foils and pinch seals and greatly augment the strength of bondage therebetween. Evidently, such firm bondage helps minimize the relative sliding of the foils and the pinch seals, the creation of gaps therebetween, the development of cracks in the glass, and eventually the leakage of the gases through the cracks.

Figure 3:
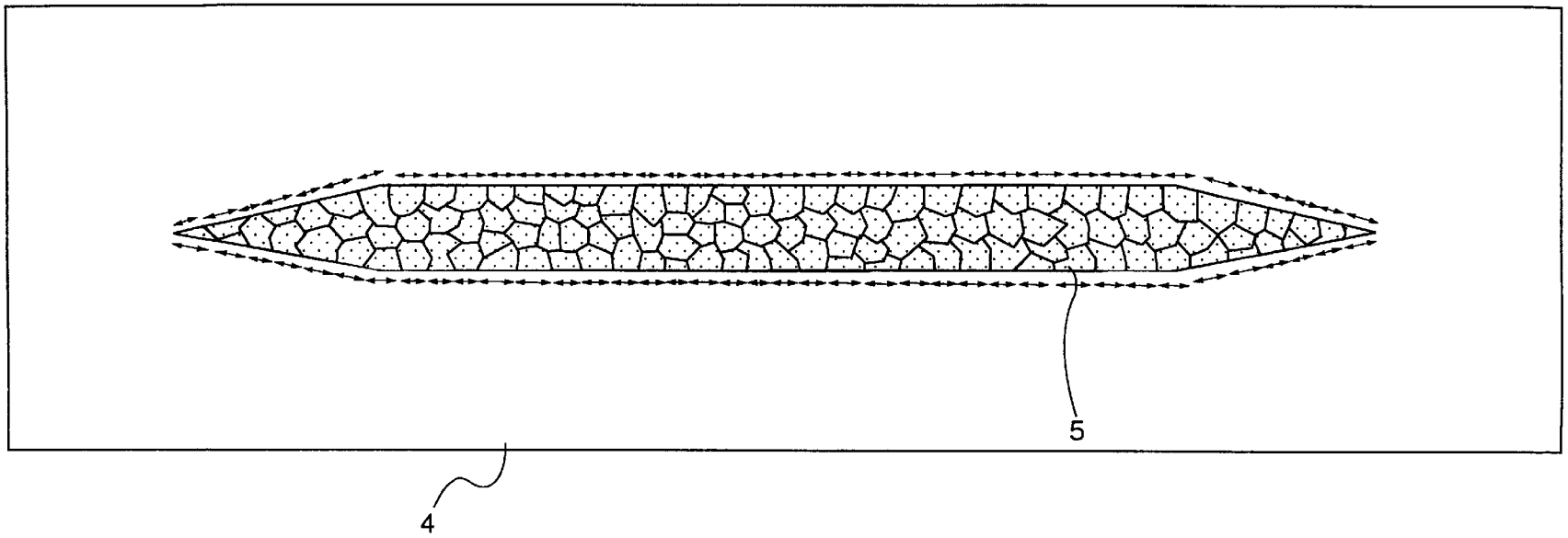
FIG. 3 is an enlarged sectional view of one of the improved molybdenum foils of the FIG. 1 lamp, the view being explanatory of the reduced thermal expansion of the molybdenum foil with its fine crystal grains.
Figure 4:
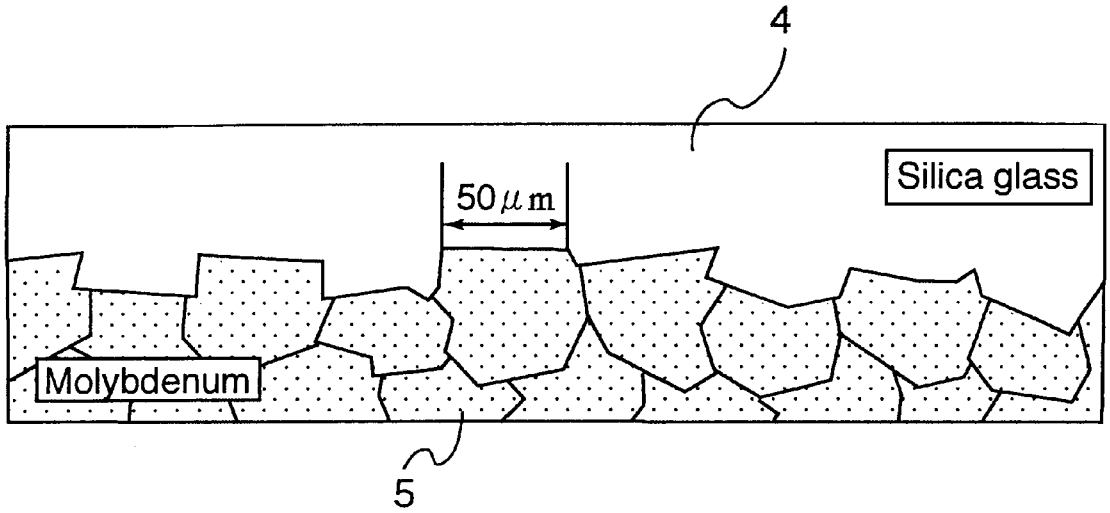
FIG. 4 is a still more enlarged, fragmentary section through the FIG. 3 molybdenum foil, the view showing in particular the highly irregular interface between the molybdenum foil and the silica glass pinch seal.
Figure 5:
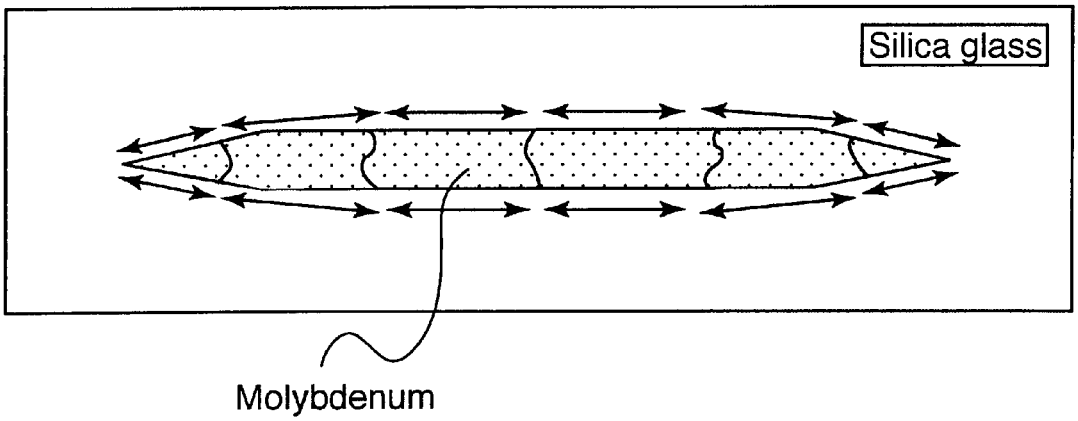
Fig. 5 PRIOR ART
FIG. 5 is a view similar to FIG. 3 but showing the coarse crystal grains of the prior art molybdenum foil.
Figure 6:
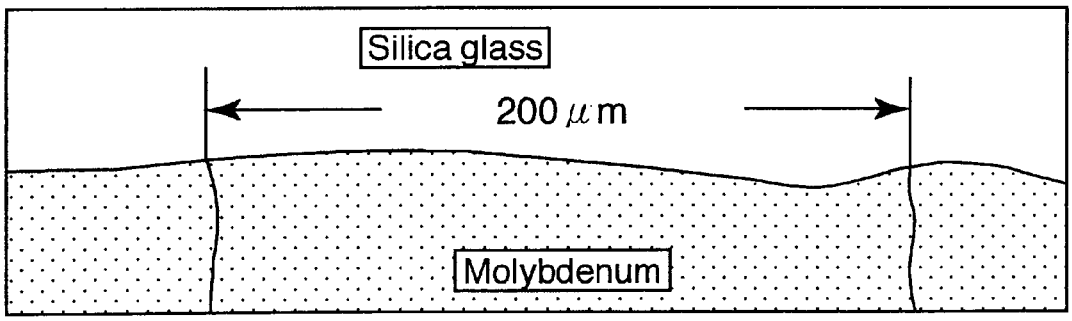
Fig. 6 PRIOR ART
FIG. 6 is a view similar to FIG. 4 but showing in particular the smooth interface between the prior art molybdenum foil and the silica glass pinch seal.

These characteristics and accruing advantages of the doped molybdenum foils according to the invention will be better appreciated by referring to FIG. 5 which shows, in a view corresponding to FIG. 3, the coarse recrystallization grains of the conventional molybdenum foils not doped with yttria. Such coarse grains provide a smooth interface with the silica glass, as pictured in FIG. 6. The inconveniences arising from this smooth interface, in sharp contrast to the irregular, minutely zigzagging interface of FIG. 4 according to the invention, have been previously pointed out during description of the background of the invention.

Despite the foregoing detailed disclosure it is not desired that the present invention be limited by the exact showing of the drawings or the description thereof. For example, the doping of molybdenum with yttria is not considered the only possible way of making the recrystallization grains of the molybdenum foils not more than 50 microns in size.

Foils of conventional compositions may be employed if the lamp envelope is pinch sealed at a lower temperature, or in a shorter period of time, than heretofore, thereby minimizing molybdenum recrystallization and so keeping the resulting crystal grains 50 microns or less.

It is also understood that the improved lamp according to the invention finds applications other than vehicular use. Further a variety of modifications or alterations of the illustrated embodiment may be made in order to meet design preferences or the requirements of each specific application. The invention should therefore be considered broadly and in a manner consistent with the fair meaning or proper scope of the attached claims.

What is claimed is:

1. A metallic halide lamp comprising:

an envelope of vitreous material with a pair of pinch seals;

a pair of electrodes partly buried one in each pinch seal;

a pair of lead wires partly buried one in each pinch seal; and a pair of foils of molybdenum wholly buried one in each pinch seal for electrically interconnecting the electrodes and the leads;

wherein the molybdenum foils have recrystallization grains of not more than approximately 50 microns in size.

2. The metallic halide lamp of claim 1 wherein the molybdenum foils contain yttrium oxide.

3. The metallic halide lamp of claim 2 wherein the yttrium oxide is present in the molybdenum foils in a quantity from about 0.1% to about 2.0% of the molybdenum weight.

* * * * *